US005594409A

United States Patent [19]

Shank

[11] Patent Number: 5,594,409

[45] Date of Patent: Jan. 14, 1997

[54] CUSTOMER ACTIVATED DEVICE

[76] Inventor: Edward J. Shank, 6401 Randy Dr., Charlotte, N.C. 28241

[21] Appl. No.: 194,474

[22] Filed: Jan. 31, 1994

[51] Int. Cl.[6] ..... G08B 5/00

[52] U.S. Cl. ..... 340/326; 340/286.06; 340/286.09; 340/332

[58] Field of Search ..... 340/326, 332, 340/286.06, 286.09

[56] References Cited

U.S. PATENT DOCUMENTS

| | | | |
|---|---|---|---|
| 1,796,668 | 3/1931 | Sarfaty | 340/286.09 |
| 3,810,164 | 5/1974 | Lambert | 340/332 |
| 4,701,849 | 10/1987 | Elden | 364/401 |
| 4,777,488 | 10/1988 | Carlman, Jr. et al. | 340/825.72 |
| 5,355,115 | 10/1994 | Goor et al. | 340/321 |

FOREIGN PATENT DOCUMENTS

| | | | |
|---|---|---|---|
| 1321598 | 12/1989 | Japan | 340/286.09 |

*Primary Examiner*—Brent A. Swarthout
*Assistant Examiner*—Edward Lefkowitz
*Attorney, Agent, or Firm*—A. Milton Cornwell, Jr.

[57] ABSTRACT

The preferred embodiment of the invention comprises proximity actuated signalling apparatus, for use in restaurants and the like, permitting a customer to conveniently inform service personnel that service is desired. A local unit positioned within a convenient distance of the customer is actuated by the customer touching the unit to turn on a light emitting indicator. Optionally, a transmitter is actuated to generate a radiated signal which turns on one or more remote indicators.

4 Claims, 3 Drawing Sheets

CUSTOMER ACTIVATED DEVICE

BACKGROUND OF THE INVENTION

1. Field of the Invention

This invention relates in general to signalling systems and, more particularly, to an apparatus and a method usable in bars, restaurants, or the like to aid a customer in indicating that service is desired.

2. Description of the Prior Art

In a bar, restaurant or similar facility, a single attendant may be at any location within the establishment and yet be responsible for servicing numerous customers. Ordinarily, a customer wishing service waits for the nearest attendant to approach him or her.

U.S. Pat. No. 3,810,164 to Adelor A. Lambert shows a prior art system suitable for use in bars. This patent discloses a plurality of activation units mounted on a bar counter top. Each activation unit is activated by placing a glass, bottle, or other weighted object on top of a platform thereby turning on lamps both near the activation unit and at a remote location. The activation unit is deactivated by removing the object from the platform. Each activation unit must be directly wired to the power source and to the remote indicator. As a result, it is cumbersome to install the activation units and once installed, the activation units are not easily moved to other locations, even on the same table. This makes it difficult to use that device in rooms whose layout is designed to be easily changeable by the rearranging of tables. U.S. Pat. No. 3,076,185, to E. S. Ida and U.S. Pat. No. 3,240,989, to G. K. B. T. Grunwaldt are also of interest.

SUMMARY OF THE INVENTION

The preferred embodiment of the invention comprises an apparatus for activating an indicator having at least first and second states. The indicator is switched between its two states by a proximity actuated circuit. A power source and the proximity actuated circuit are mounted in an enclosure comprising a simulated beverage bottle. Objects within a predetermined distance of the apparatus actuates a proximity sensor mounted near the opening of the simulated beverage bottle to switch the indicator to at least one of its two states. Optionally, coded radiated signals may be provided to activate one or more remote indicators.

DETAILED DESCRIPTION OF THE INVENTION

Figure 1:
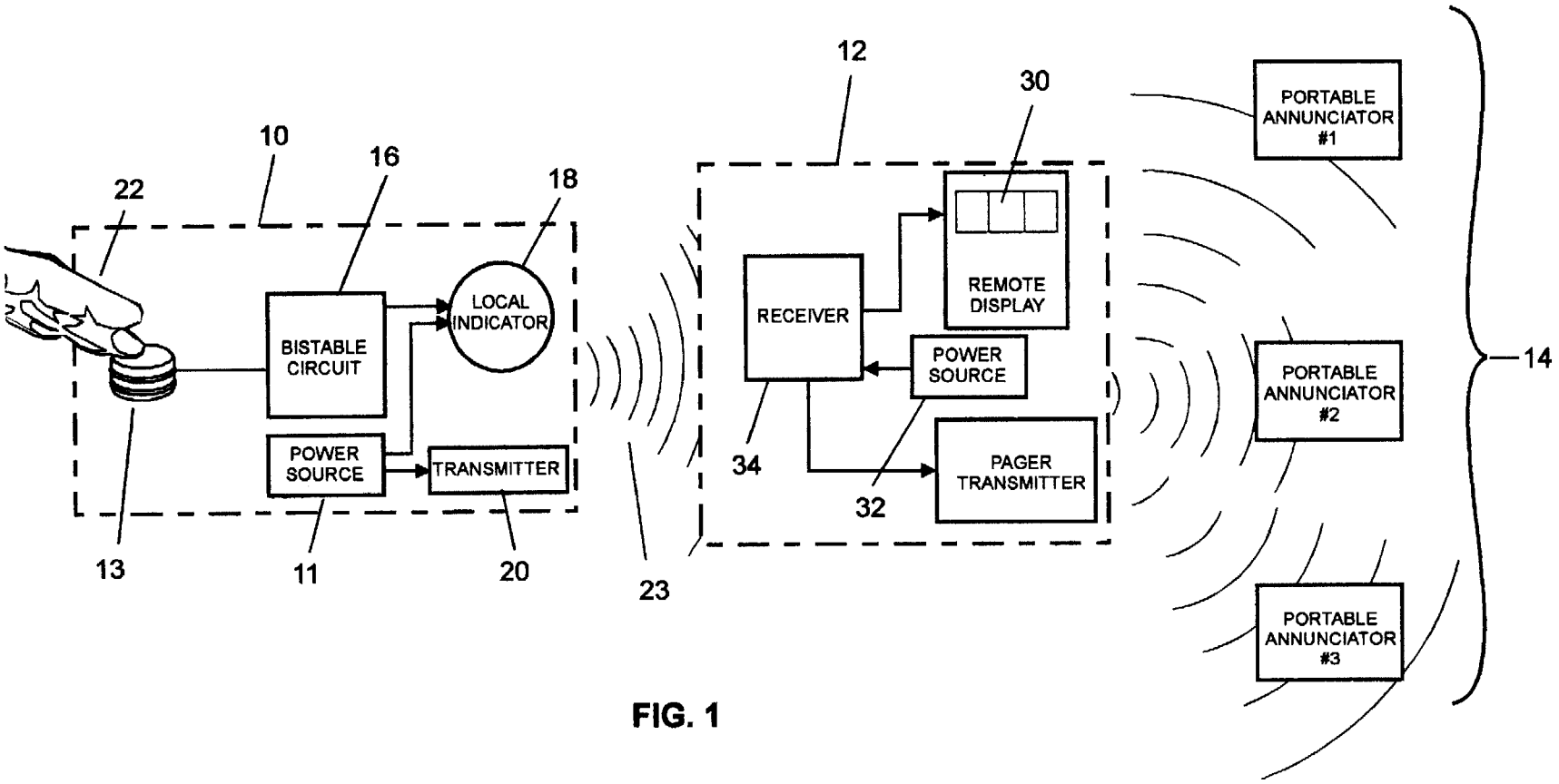
FIG. 1 is a functional block diagram of the preferred embodiment of the invention.

FIG. 1 is a generalized functional block diagram of the system comprising the invention. The operation of the system is described below with respect to a typical system which includes a local indicator device 10, a typical remote indicator 12 and a plurality of portable annunciators 14. A customer desiring service activates the local indicator device

10 which in turn activates the remote indicator 12 and the annunciator 14.

Specifically, the system includes one or more self-contained customer activated (local) indicator device 10, and optionally includes at least one remote indicator 12. One or more portable annunciators collectively illustrate at reference numeral 14 may also be selectively activated by the remote indicator 12.

Functionally, the remote indicator 12 provides a central location permitting service personnel to determine which customer desires service. The remote indicator may be positioned at any location selected to permit the service personnel to periodically and conveniently determine which customer desires service. The portable annunciators which may resemble pagers, include a suitable indicator to permit service personnel to determine which customer desires service without access to either the customer activated device 10 or the remote indicator 12. Thus, in a typical system the service person responsible has three possible methods of determining that a customer desires service.

A typical customer activated indicator device 10 includes a power source 11, preferably a rechargeable battery, a proximity actuated circuit including a sensor 13 and at least a bistable circuit 16, an indicator 18 and optionally a transmitter 20 for generating a coded radiated signal comprising waves 23. Stated another way, if the application is such that remote indicators are not desired, the transmitter 20 is not required.

Typical radiated waves include conventional radio and optical signals. In applications using a plurality of customer activated device 10, each device has a unique identification code. When the local transmitter 20 is energized, the radiated wave 23 is modulated to include this identification code. Other details of the invention are discussed in more detail below with reference to the other drawings.

Specifically, the proximity sensor 13 is responsive to objects within a predetermined range of the sensor 13, such as the customer's finger 22, to actuate a bistable circuit 16. When activated by the proximity sensor 13, the bistable circuit 16 is triggered to a first state which activates a local indicator 18. Optionally, as previously discussed, the bistable circuit 16 also activates a transmitter 20 to generate a coded radiated signal 23 modulated with the identification code. This signal is sensed by a receiver 34 to selectively activate a remote display 30. Stated another way, the receiver 34 may be programmed to assign any one of the indicator device 30 to a particular identification code. Remote display 30 typically includes a plurality of indicators collectively illustrated at reference numeral 30, which may generate visual, audible or some other type of suitable and usefull indication of activation of the local indicator device 10.

Functionally, the remote indicator 12 includes a power source 32, a programmable receiver 34 for sensing the radiated wave 23 and remote indicator 30. The receiver 34 in the remote unit 30 is programmable to sense the radiated signal 23 and recover the identification codes to selectively activate remote indicator 30 to identify the specific customer activated unit. That is, the receiver 34 recovers the identification code and activates an indicator assigned to the identification code by the program.

The radiated signal 23 may be coded, using techniques that are similar to those used in conventional garage door openers. That being the case, it is not believed necessary to describe the coding technique in detail.

Figure 2:
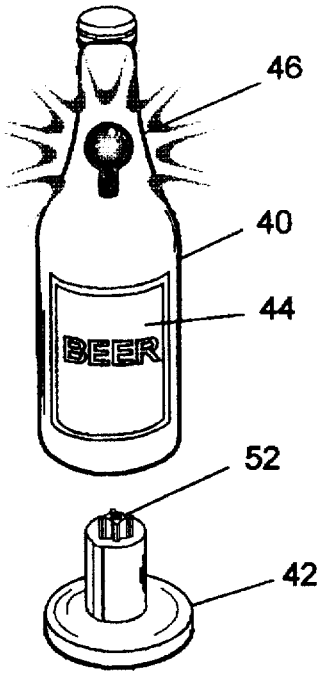
FIG. 2 is a functional drawing illustrating the preferred embodiment of the invention.

The customer activated indicator device 10 may take a variety of forms with the preferred embodiment, illustrated in FIG. 2. This embodiment of the invention resembles a beverage bottle and includes an upper portion 40 and a lower portion 42. A simulated label 44 promotes products sold by the establishment. For example, the customer activated indicator illustrated is specifically designed to be used by a bar which serves "Beer". In such an application, the simulated label 44 is printed to promote this product. Activation of the indicator 46, Which may be a conventional light emitting device, illustrates the simulated label 44 thereby suggesting that beer is available. In this embodiment, the cap of the simulated bottle serves as the sensor and may be coupled to the electronic circuity using any suitable technique.

The lower portion 42 of the simulated beverage bottle is the power source. An upwardly extending rib portion mates with a groove in the upper portion 40 assuring that the upper and lower portions mate properly. A two conductor receptacle 52 mates with a suitable connector in the upper portion 40. The lower portion 42 (power supply) may comprise a rechargeable battery or a replaceable battery. A suitable battery charger is subsequently discussed.

Figure 3:
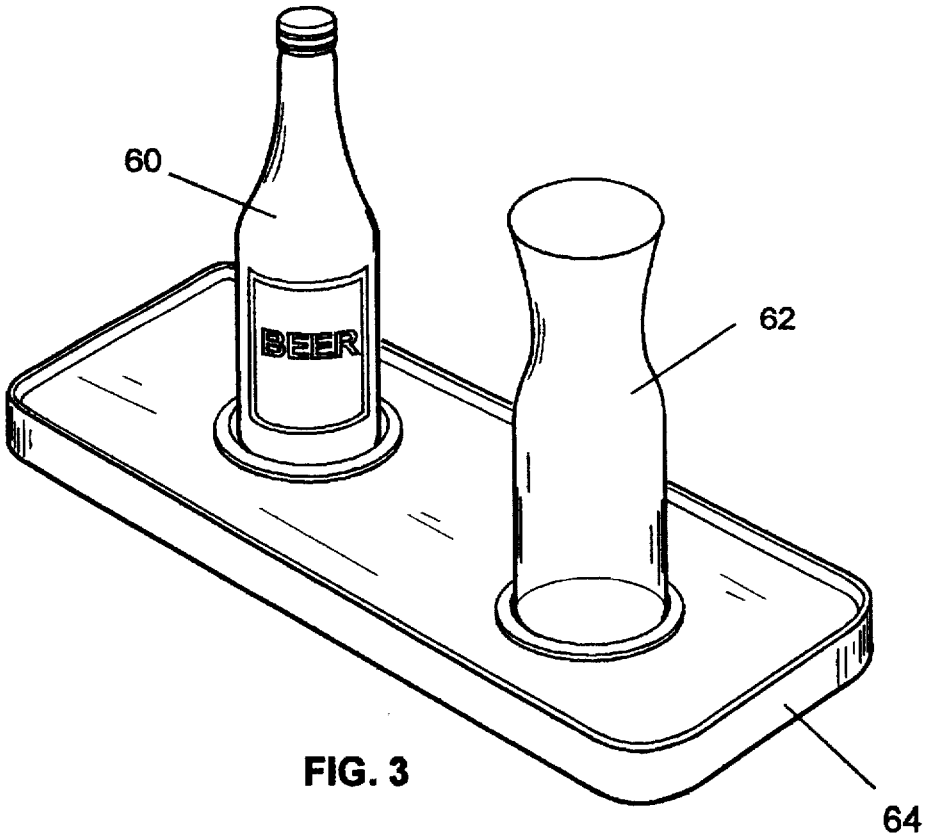
FIG. 3 illustrates the use of the customer activated device in conjunction with a gratuity collection jar.

In another embodiment of the invention, illustrated in FIG. 3, a customer activated indicator 60, of the type discussed above, is combined with a gratuity jar 62; with the customer activated indicator 60 and the gratuity jar 62 being supported by a common decorative base 64. In this embodiment the customer activated indicator may include all of the features discussed above. This embodiment is designed to be positioned on a conventional bar to provide customers a convenient means of indicating the desire for service, for promoting products sold by the establishment and providing a suggestion that tips are appreciated by the service personnel.

Figure 4:
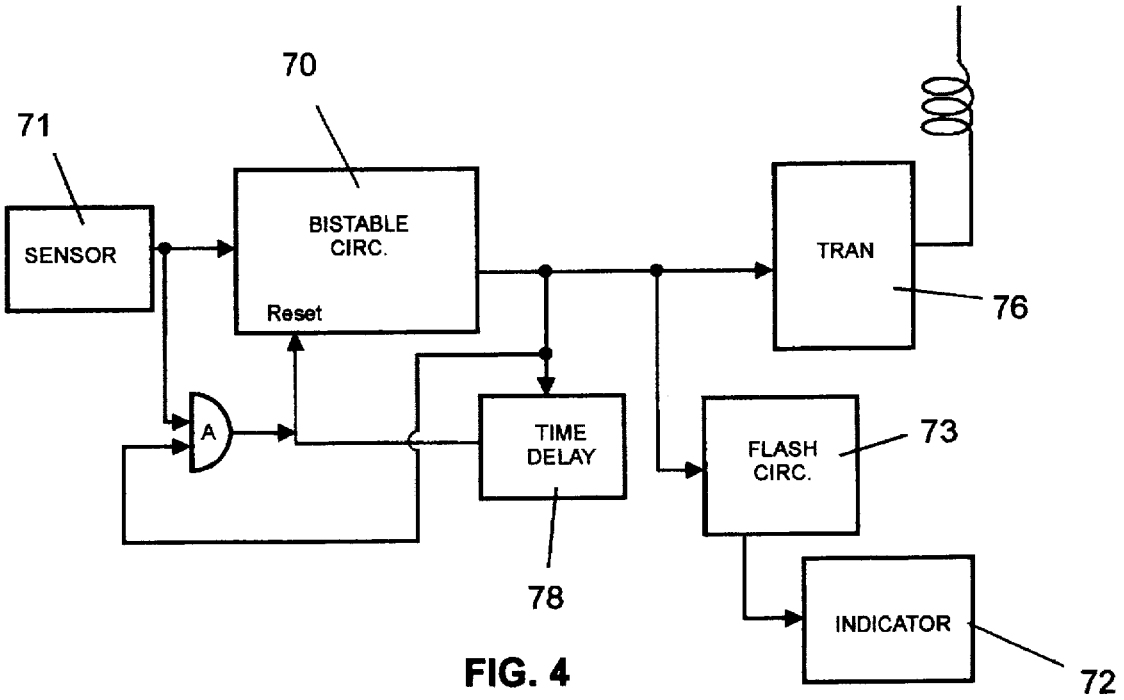
FIG. 4 is a generalized functional block diagram of the electronic circuitry used in the customer activated device.

Circuity usable in the customer activated indicator is illustrated in FIG. 4. Functionally, the bistable circuit 70 is activated by a signal generated by the proximity sensor 71 to trigger the bistable circuit 70 to a selected first state. In the selected first state, the output signal of the bistable circuit 70 activates the local indicator 72 through a flasher 73 and optionally activates the transmitter 76 to generate the radiated coded signal 23. Additionally, the output signal of the bistable circuit 70 is coupled to the input terminal of a time delay circuit 78 to activate this circuit to generate a pulse after a predetermined time interval. This pulse resets the bistable circuit 70 to its second state. Resetting the bistable circuit disables the transmitter 76 and the indicator 72. Additionally, the output signal of the bistable circuit 70 is combined in a two input gate circuit with the output signal of the proximity sensor 71 to permit this sensor to be used to reset the bistable circuit 70.

These features assure that the customer activated indicator 10 will not be left permanently in an energized state. This is especially important when the device is operated from batteries, either rechargeable or replaceable.

As discussed above, in the preferred embodiment the power source 42 is a rechargeable battery packaged as illustrated in FIG. 2. This configuration requires suitable means for recharging the battery.

Figure 5:
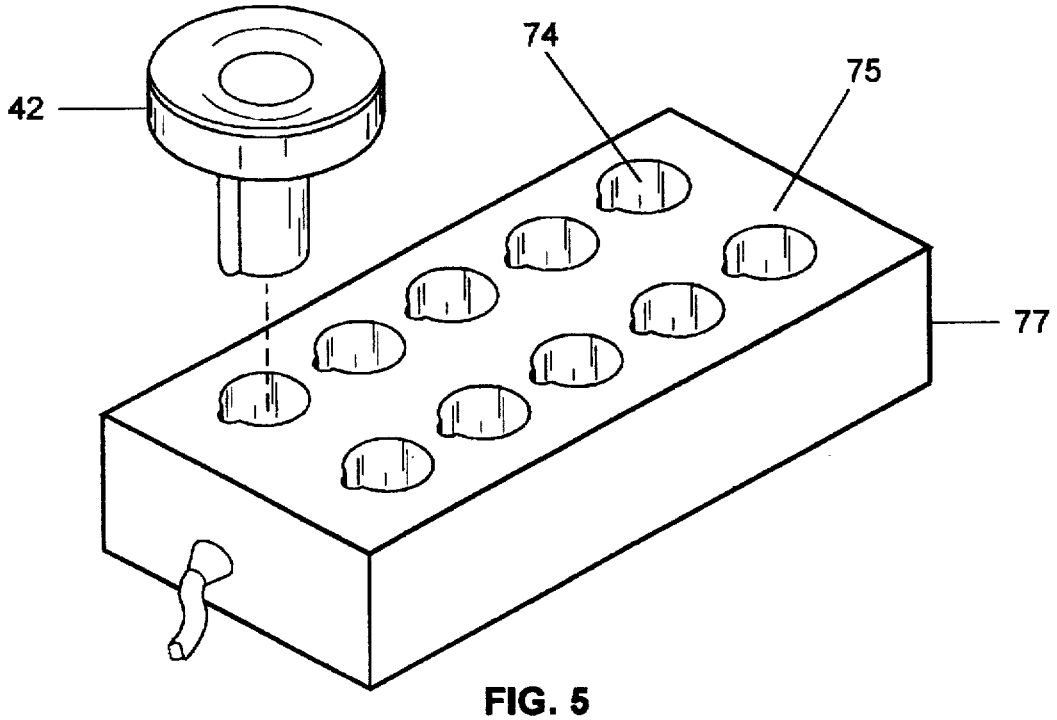
FIG. 5 is a drawing illustrating the battery charger.

The preferred embodiment of a suitable battery charger is illustrated in FIG. 5. More specifically, the charger 77 includes a substantially flat top surface 75 having a plurality of identical sockets, typically illustrated at reference numeral 74, therein. Recharging a typical battery requires that it be removed (uncoupled) from the upper portion 40 of the customer activated device 10, inserted as illustrated in FIG. 5 and inserted into a vacant socket in the battery charger 77. When so inverted into the charger 77, it provides a charging current to the battery.

The above described embodiments are merely illustrative of the principles of the invention. Variations and modifications in the above-described invention will be readily apparent to those skilled in the art. Such variation could be made without departing from the spirit and scope of the invention as expressed in the appended claims. Additionally, the invention can be implemented using commercially available components and conventional construction techniques.

I claim:

1. A portable customer activated device for activating an indicator having an on and off state, said portable device including a proximity actuated circuit, a power source, and an enclosure; said enclosure comprising a simulated beverage bottle, said indicator, said proximity actuated circuit and said power source being mounted inside said enclosure, said proximity actuated circuit including a proximity sensor mounted near the opening of said simulated beverage bottle whereby said customer selectively activates said device by positioning a selected portion of said customer's body within a predetermined distance of said sensor to activate said proximity actuated circuit to switch said indicator to said on state to indicate to service personnel that said customer desires service and thereby causing said proximity actuated circuit to latch in the on state until switched to the off state.

2. The device of claim 1 wherein said proximity actuated circuit is switched to the off state by means of an automation time out.

3. The device of claim 1 wherein said proximity actuated circuit is switched to the off state by means of service personnel.

4. The device of claim 1 further including transmitter means responsive to said proximity actuated circuit to generate a radiated signal which activates a remote indicator in response to the activation of said proximity actuated circuit.

* * * * *